US009884481B2

(12) United States Patent
Ohara

(10) Patent No.: US 9,884,481 B2
(45) Date of Patent: Feb. 6, 2018

(54) PRINTING APPARATUS AND PRINTING METHOD

(71) Applicant: MIMAKI ENGINEERING CO., LTD., Nagano (JP)

(72) Inventor: Eiichi Ohara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/125,184

(22) PCT Filed: Mar. 13, 2015

(86) PCT No.: PCT/JP2015/057423

§ 371 (c)(1),
(2) Date: Sep. 11, 2016

(87) PCT Pub. No.: WO2015/137479

PCT Pub. Date: Sep. 17, 2015

(65) Prior Publication Data

US 2017/0096003 A1 Apr. 6, 2017

(30) Foreign Application Priority Data

Mar. 13, 2014 (JP) ..... 2014-050014

(51) Int. Cl.
*B41J 2/045* (2006.01)
*B41J 2/21* (2006.01)

(52) U.S. Cl.
CPC ..... *B41J 2/04505* (2013.01); *B41J 2/04586* (2013.01); *B41J 2/2103* (2013.01)

(58) Field of Classification Search
CPC ..... B41J 2/2132; B41J 2/5056; B41J 11/42; B41J 2/2139; B41J 2/2142; B41J 2/04581;

(Continued)

(56) References Cited

U.S. PATENT DOCUMENTS 7,575,299 B2 * 8/2009 Otokita ..... B41J 2/155 347/15

FOREIGN PATENT DOCUMENTS

JP S58194541 11/1983
JP H06106736 4/1994

(Continued)

OTHER PUBLICATIONS

"International Search Report (Form PCT/ISA/210) of PCT/JP2015/057423", dated Jun. 9, 2015, with English translation thereof, pp. 1-4.

(Continued)

*Primary Examiner* — Lamson Nguyen
(74) *Attorney, Agent, or Firm* — JCIPRNET

(57) ABSTRACT

A printing apparatus including a head unit 12, a main scan driver 14, and a controller 20 is provided. The head unit 12 includes a first-color nozzle and a second-color nozzle, and performs main scan operations in an outward direction and main scan operations in a homeward direction. During each main scan operation, the controller 20 selects some pixels, as first-color ejection object pixels for which ink drops of a first color should be ejected, from pixels included in an area of a medium 50 which is an object of the corresponding main scan operation, and selects at least some pixels other than the first-color ejection object pixels, as second-color ejection object pixels for which ink drops of a second color should be ejected, from the pixels included in the area of the medium which is the object of the corresponding main scan operation.

9 Claims, 8 Drawing Sheets

(58) Field of Classification Search
CPC .. B41J 2/04595; B41J 11/008; B41J 2/04586; B41J 2/2103
See application file for complete search history.

(56) References Cited

FOREIGN PATENT DOCUMENTS

| | | |
|---|---|---|
| JP | 2006256009 | 9/2006 |
| JP | 2010017975 | 1/2010 |

OTHER PUBLICATIONS

"Office Action of Japan Counterpart Application," with English translation thereof, dated Sep. 5, 2017, p1-p9.

* cited by examiner

PRINTING APPARATUS AND PRINTING METHOD

CROSS-REFERENCE TO RELATED APPLICATION

This application is a 371 of international application of PCT application serial no. PCT/JP2015/057423, filed on Mar. 13, 2015, which claims the priority benefits of Japan Patent Application No. 2014-050014, filed on Mar. 13, 2014. The entirety of each of the above-mentioned patent applications is hereby incorporated by reference herein and made a part of this specification.

TECHNICAL FIELD

The disclosure relates to a printing apparatus and a printing method.

BACKGROUND ART

Inkjet printers for performing printing in an inkjet scheme according to the related art are being widely used (see PTL 1 for instance). Also, as a printing method which is performed in inkjet printers, a method of performing main scan operations (scanning operations) of moving an inkjet head in a predetermined main scan direction is being widely used.

CITATION LIST

Patent Literature

PTL 1: JP-A-2006-256009

SUMMARY OF DISCLOSURE

Technical Problem

Some inkjet printers use a plurality of inkjet heads for ejecting ink drops of different colors, for example, in a case of performing color printing. In this case, the plurality of inkjet heads is installed side by side in a main scan direction, and ejects ink drops of the individual colors onto the same position of a medium during each main scan operation. Also, for example, in way to increase the printing speed, some inkjet printers perform main scan operations in the outward direction and homeward direction of the main scan direction.

However, in the case of using a plurality of inkjet heads for different colors arranged side by side in the main scan direction, if main scan operations are performed in the outward direction and the homeward direction, main scan operations which are performed in the outward direction and main scan operations which are performed in the homeward direction are different from each other in the order in which ink dots of different colors overlap at the positions of individual pixels. Also, as a result, color unevenness may occur in the print result.

More specifically, for example, in this case, the order in which ink dots of different colors overlap at the positions of individual pixels during main scan operations of the outward direction is the reverse of the order during main scan operations of the homeward direction. For this reason, between areas subjected to printing by main scan operations of the outward direction and areas subjected to printing by main scan operations of the homeward direction, a difference in tone which can be visibly recognized may occur.

Also, as a result, some problems such as color transition may occur. Color transition means that the tones of band-like areas formed by main scan operations changes alternately. Further, this color unevenness causes the quality of printing to deteriorate.

For this reason, it has been desired to perform printing by a method capable of appropriately suppressing occurrence of color unevenness. Therefore the disclosure provides a printing apparatus and a printing method capable of solving the above described problems.

Solution to Problem

Some inkjet printer perform printing in a mode in which the movement speed of the inkjet head during main scan operations is, for example, twice a standard speed (a high-speed scan mode). The inventor of this application first found that, in such a case of performing printing in a high-speed scan mode, by using a method of selecting pixels to be ink dots during each main scan operation different from known methods, it is possible to appropriately suppress color unevenness such as color transition. Also, by more earnest researches, the inventor of this application found that, even in modes other than the high-speed scan mode, from the same point of view, it may be possible to suppress color unevenness such as color transition. Accordingly, the disclosure has the following configurations.

A printing apparatus of the disclosure is a printing apparatus for performing printing on a medium in an inkjet mode, including: a head unit configured to eject ink drops onto the medium by performing main scan operations of ejecting ink drops while moving in a predetermined main scan direction; a main scan driver configured to drive the head unit to perform the main scan operations; and a controller configured to control the printing operation on the medium by controlling the operations of the head unit and the main scan driver, in which the head unit includes a first-color nozzle for ejecting ink drops of a first color, and a second-color nozzle for ejecting ink drops of a second color different from the first color, and the first-color nozzle and the second-color nozzle are installed, such that they are arranged side by side in the main scan direction and their positions in a sub scan direction perpendicular to the main scan direction are aligned, and in a case where one direction of the main scan direction is defined as an outward direction, and the opposite direction to the outward direction is defined as homeward direction, the head unit performs main scan operations of the outward direction in which the head ejects ink drops while moving in the outward direction, and performs main scan operations of the homeward direction in which the head ejects ink drops while moving in the homeward direction, and during each main scan operation, the controller selects some pixels, as first-color ejection object pixels for which ink drops of the first color should be ejected, from pixels included in an area of the medium which is an object of the corresponding main scan operation, and selects at least some pixels other than the first-color ejection object pixels, as second-color ejection object pixels for which ink drops of the second color should be ejected, from the pixels included in the area of the medium which is the object of the corresponding main scan operation.

The head unit is, for example, a part having inkjet heads. For example, the head unit may include an inkjet head for the first color, and an inkjet head for the second color. In this case, the inkjet head for the first color is an inkjet head having nozzles for the first color. Also, the inkjet head for the second color is an inkjet head having nozzles for the second color.

In a case of performing main scan operations in the outward direction and the homeward direction, the reason why color unevenness such as color transition occurs is that, during one main scan operation, with respect to individual pixels which are formed in a band-like area (hereinafter, referred to as a band area), the color overlap order is constant, and the color overlap way in a case of performing a main scan operation in the outward direction is different from the color overlap way in a case of performing a main scan operation in the homeward direction. In this case, with respect to ink dots of a plurality of colors which are formed by ink drops of different colors ejected onto the same pixel positions, a case where colors overlap means, for example, a case where ink drops of the different colors superimposed on the medium in the ejection order. Also, in a case where the color overlap way varies depending on band areas, for example, between odd-numbered band areas and even-numbered band areas, a difference in tone occurs and color unevenness such as color transition occurs.

In contrast with this in the above described configuration, during each main scan operation, the controller selects different pixels as the first-color ejection object pixels and the second-color ejection object pixels, respectively. In this case, with respect to every pixel in one band area, the order in which the colors overlap is not constant. Therefore, according to this configuration, it is possible to appropriately perform printing, for example, by a method capable of appropriately suppressing occurrence of color unevenness. Also, as a result, for example, it is possible to more appropriately perform high-quality printing.

Also, in this configuration, for example, the printing apparatus may further include a sub scan driver. The sub scan driver relatively moves the head unit with respect to the medium in the sub scan direction in periods between main scan operations, for example, whenever a predetermined number of (for example, one) main scan operations are performed.

Also, during each main scan operation, the controller selects first-color ejection object pixels and second-color ejection object pixels, more specifically, for example, such that the first-color ejection object pixels and the second-color ejection object pixels become different from each other. In this case, the case where the first-color ejection object pixels and the second-color ejection object pixels become different from each other means, for example, a case where a plurality of pixels other than the first-color ejection object pixels is selected as the second-color ejection object pixels.

Also, the case where the first-color ejection object pixels and the second-color ejection object pixels become different from each other may be, for example, a case where the first-color ejection object pixels and the second-color ejection object pixels do not become substantially the same as each other. For example, as long as the effect of suppressing color unevenness such as color transition can be obtained, it can be considered to select the same pixels as parts of first-color ejection object pixels and second-color ejection object pixels. Even in this case, with respect to the other pixels, it is possible to appropriately prevent the color overlap way from being constant in one band area. Also, as a result, for example, it is possible to appropriately perform high-quality printing.

Also, in this configuration, the operation of selecting the first pixels and the second pixels may be performed, for example, in a case of performing printing in a specific mode such as a high-speed scan mode. Also, in this configuration, the number of main scan operations which is performed on each position of the medium may be, for example, 1. Also, for example, in a case of performing printing in a multi-pass mode, in each printing pass, such pixel selection may be performed to select pixels as ink-drop ejection objects.

In the printing apparatus of the disclosure, the head unit may include a first-color nozzle row having a plurality of first-color nozzles arranged side by side in the sub scan direction, and a second-color nozzle row having a plurality of second-color nozzles arranged side by side in the sub scan direction, and the first-color nozzle row and the second-color nozzle row may be formed side by side in the main scan direction.

In this configuration, since a plurality of nozzles is used for each color, it is possible to perform printing faster. Also, even in this case, it is possible to appropriately suppress color unevenness and the like by appropriately preventing the color overlap way from being constant in one band area. Therefore, according to this configuration, for example, it is possible to more appropriately perform high-quality printing.

In the printing apparatus of the disclosure, the controller may be able to set a predetermined first speed, and a second speed higher than the first speed, as the movement speed of the head unit in a case of performing the main scan operations, and during a main scan operation of moving the head unit at the second speed, the controller may select some pixels, as first-color ejection object pixels for which ink drops of the first color should be ejected, from pixels included in an area of the medium which is an object of the corresponding main scan operation, and selects at least some pixels other than the first-color ejection object pixels, as second-color ejection object pixels for which ink drops of the second color should be ejected, from the pixels included in the area of the medium which is the object of the corresponding main scan operation.

The first speed is, for example, the movement speed of the head unit in a case of performing printing in a standard mode. Also, the second speed is, for example, the movement speed of the head unit in a case of performing a high-speed scan mode. The second speed may be twice the first speed. According to this configuration, in a case of performing printing in a specific mode such as the high-speed scan mode, it is possible to appropriately suppress color unevenness and the like.

In the printing apparatus of the disclosure, during each main scan operation on each position of the medium, the controller may select the first-color ejection object pixels and the second-color ejection object pixels such that the first-color ejection object pixels and the second-color ejection object pixels are arranged alternately in the main scan direction.

According to this configuration, for example, during each main scan operation, it is possible to appropriately select different pixels as first-color ejection object pixels and second-color ejection object pixels, respectively. Also, as a result, it is possible to more appropriately suppress color unevenness and the like. Also, particularly, for example, in a case of performing printing in the high-speed scan mode, according to this configuration, with respect to the first color and the second color, it is possible to surely and appropriately prevent the colors from overlapping at individual pixel positions. Also, as a result, it is possible to more surely suppress color unevenness and the like.

The printing apparatus of the disclosure may perform printing on the medium by a multi-pass mode in which a plurality of main scan operations corresponding to a plurality of printing passes is performed on each position of the medium. According to this configuration, for example, in a case of performing printing in a multi-pass mode, it is possible to appropriately select different pixels as first-color ejection object pixels and second-color ejection object pixels, respectively. Also, as a result, for example, it is possible to more appropriately prevent the color overlap way from being constant in one band area, and it is possible to appropriately suppress color unevenness and the like.

Also, in a case of performing printing in the multi-pass mode, a band area may be an area corresponding to the width of one printing pass. Also, in each of the plurality of printing passes which is performed on each position of a medium, on the basis of mask data for designating pixels for which ink drops should be ejected, the controller may select first-color ejection object pixels and second-color ejection object pixels. In this case, for example, the controller selects first-color ejection object pixels and second-color ejection object pixels on the basis of different mask data items.

The printing apparatus of the disclosure may perform printing using ink of three or more colors, and the head unit may include a plurality of nozzles for ejecting ink drops of the three or more colors, respectively, and during each main scan operation, the head unit may eject ink drops of the three or more colors, onto different pixel positions, respectively. The ink of three or more colors may be ink of three or more colors of individual colors such as C (cyan), M (magenta), Y (yellow), and K (black).

According to this configuration, it is possible to more appropriately prevent the color overlap way from being constant in one band area. Also, as a result, it is possible to appropriately suppress color unevenness and the like.

The printing apparatus of the disclosure may perform printing using ink of three or more colors, and the head unit may include a plurality of nozzles for ejecting ink drops of the three or more colors, respectively, and the plurality of nozzles for ejecting ink drops of the three or more colors may be installed, such that they are arranged side by side in the main scan direction and their positions in the sub scan direction are aligned, and the first-color nozzle may be any one nozzle of the arrangement of the plurality of nozzles arranged side by side in the main scan direction, and the second-color nozzle may be any one nozzle other than the first-color nozzle, of the plurality of nozzles arranged side by side in the main scan direction. The ink of three or more colors may be ink of three or more colors of individual colors such as C, M, Y, and K.

In a case of using many colors in printing, during each main scan operation, with respect to every color, different pixels may be selected as ejection object pixels for the individual colors, respectively. In this case, since the degree of freedom in selecting pixels decreases, it may be impossible to appropriately select pixels. In contrast with this in the above described configuration, by focusing attention on some colors, not all colors, even in a case of using many colors, during each main scan operation, it is possible to more easily and appropriately select appropriate pixels as ink-drop ejection objects.

Also, in this case, it is preferable to select, among colors used for printing, a combination of such colors that the order in which the colors overlap is likely to influence visibility, as the first color and the second color. According to this configuration, it is possible to more appropriately suppress color unevenness and the like.

A printing method of the disclosure is a printing method of performing printing on a medium in an inkjet mode, in which the printing method uses a head unit configured to eject ink drops onto the medium by performing main scan operations of ejecting ink drops while moving in a predetermined main scan direction, and the printing method controls the main scan operations of the head unit, such that the head unit performs printing on the medium, and the head unit includes a first-color nozzle for ejecting ink drops of a first color, and a second-color nozzle for ejecting ink drops of a second color different from the first color, and the first-color nozzle and the second-color nozzle are installed, such that they are arranged side by side in the main scan direction and their positions in a sub scan direction perpendicular to the main scan direction are aligned, and in a case where one direction of the main scan direction is defined as an outward direction, and the opposite direction to the outward direction is defined as homeward direction, the printing method controls the head unit such that the head unit performs main scan operations of the outward direction in which the head ejects ink drops while moving in the outward direction, and performs main scan operations of the homeward direction in which the head ejects ink drops while moving in the homeward direction, and during control on each main scan operation, the printing method selects some pixels, as first-color ejection object pixels for which ink drops of the first color should be ejected, from pixels included in an area of the medium which is an object of the corresponding main scan operation, and selects at least some pixels other than the first-color ejection object pixels, as second-color ejection object pixels for which ink drops of the second color should be ejected, from the pixels included in the area of the medium which is the object of the corresponding main scan operation. Therefore, according to this configuration, it is possible to appropriately perform printing, for example, by a method capable of appropriately suppressing occurrence of color unevenness. Also, as a result, for example, it is possible to more appropriately perform high-quality printing.

Advantageous Effects of Disclosure

According to the disclosure, for example, it is possible to appropriately perform printing by a method capable of appropriately suppressing occurrence of color unevenness.

BRIEF DESCRIPTION OF DRAWINGS

FIGS. 1A and 1B are a front view and top view illustrating an example of the configuration of main components of the printing apparatus 10.

FIG. 2A shows an example of the overall configuration of the head unit 12. FIG. 2B shows an example of the state of the head unit 12 during a main scan operation.

FIG. 3A simply shows the configuration of the head unit 12. FIGS. 3B and 3C show examples of the states of ink dot 402*m* and ink dots 402*c* formed on a medium 50 during main scan operations.

FIG. 4A simply shows the configuration of the head unit 12. FIGS. 4B and 4C show examples of the states of ink dot 402*m* and ink dots 402*c* formed on a medium 50 during main scan operations.

FIG. 5A is a view for explaining an operation which is performed in the multi-pass mode in the configuration of the related art. FIG. 5B is a view for explaining an operation which is performed in the multi-pass mode in the present embodiment.

FIG. 6A shows an example of an ink dot arrangement formed by a first printing pass. FIGS. 6B and 6C show examples of ink-dot overlap ways after a second printing pass. FIG. 6D shows an example of ink overlap ways at individual positions on a medium.

FIG. 7A shows an example of an ink dot arrangement formed by a first printing pass. FIGS. 7B and 7C show examples of ink-dot overlap ways after a second printing pass. FIG. 7D shows an example of an ink overlap way at individual positions on a medium.

FIG. 8A shows an example of a print result in a case of using a common mask data item for the individual colors. FIG. 8B shows the example of the print result in a case of using mask data items having different patterns for individual colors.

DESCRIPTION OF EMBODIMENTS

Figure 1A:
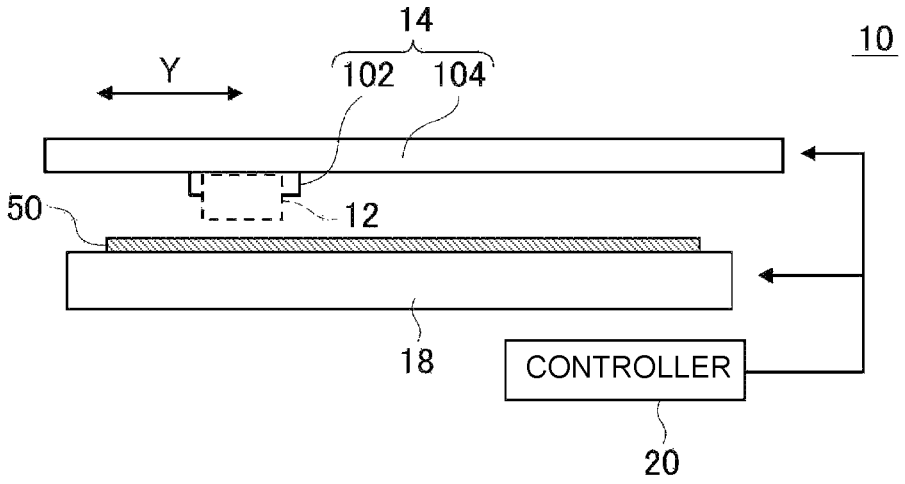
FIGS. 1A and 1B are views illustrating an example of a printing apparatus 10 according to an embodiment of the disclosure.
Figure 1B:
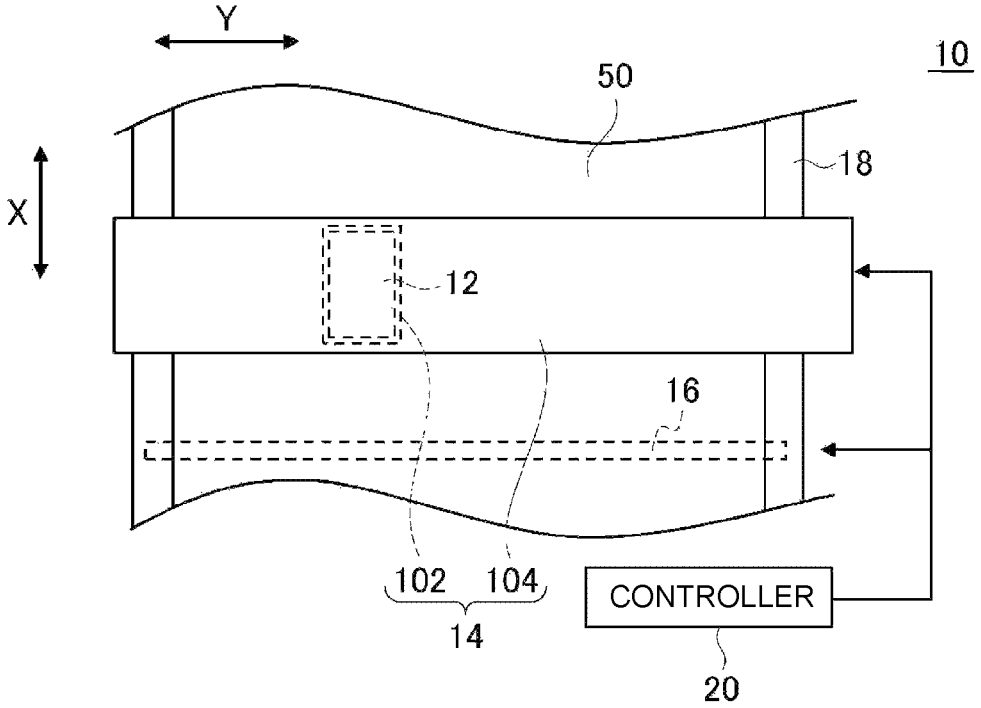

Hereinafter, an embodiment of the disclosure will be described with reference to the accompanying drawings. FIG. 1 shows an example of a printing apparatus 10 according to the embodiment of the disclosure. FIGS. 1A and 1B are a front view and top view illustrating an example of the configuration of main components of the printing apparatus 10. Also, the printing device 10 may have a configuration identical or similar to that of a known inkjet printer, except for points to be described below.

The printing apparatus 10 is an inkjet printer for performing printing in a serial mode in which an inkjet head performs main scan operations (also referred to as scanning operations). Also, in the present embodiment, the printing apparatus 10 is an inkjet printer (also referred to as a UV (ultraviolet) printer) for performing printing on a medium 50 with ultraviolet curing ink in an inkjet mode, and includes a head unit 12, a main scan driver 14, a sub scan driver 16, a platen 18, and a controller 20.

The head unit 12 is a part for performing printing on medium 50, and forms ink dots corresponding to the individual pixels of print images on the medium 50, in response to instructions of the controller 20. In the present embodiment, the head unit 12 performs printing on the medium 50 by performing main scan operations of ejecting ink drops onto the medium 50 while moving in a predetermined main scan direction (a Y direction in the drawings). Also, the head unit 12 includes components such as a plurality of inkjet heads and ultraviolet light sources. In this case, a case where the head unit 12 performs main scan operations means, for example, a case where the inkjet heads of the head unit 12 perform main scan operations. The configuration, operation, and the like of the head unit 12 will be described below in more detail and more specifically.

The main scan driver 14 includes components for driving the head unit 12 to perform main scan operations. In the present embodiment, the main scan driver 14 includes a carriage 102 and a guide rail 104. The carriage 102 holds the head unit 12 such that the nozzle rows of the inkjet heads face the medium 50. The guide rail 104 is a rail for guiding movement of the carriage 102 in the main scan direction, and moves the carriage 102 in the main scan direction in response to instructions of the controller 20.

The sub scan driver 16 includes components for driving the head unit 12 to perform sub scan operations of relatively moving the medium 50 in a sub scan direction (an X direction in the drawings) perpendicular to the main scan direction. In this case, the operation of driving the head unit 12 to perform sub scan operations means, for example, an operation of driving the inkjet heads of the head unit 12 to perform sub scan operations. Also, in the present embodiment, the sub scan driver 16 is a roller for conveying the medium 50, and conveys the medium 50 between main scan operations, thereby making the head unit 12 perform sub scan operations.

Also, for example, it can be considered to use a configuration for performing sub scan operations by moving the inkjet head side with respect to the medium 50 fixed in place (for example, an X-Y table type apparatus), without conveying the medium 50, as the configuration of the printing apparatus 10. In this case, as the sub scan driver 16, for example, a driver for moving the inkjet heads by moving the guide rail 104 in the sub san direction can be used.

The platen 18 is a board-like member for mounting the medium 50, and supports the medium 50 such that the medium faces the nozzle surfaces of the inkjet heads of the head unit 12 having nozzle rows formed thereon. Also, the controller 20 is, for example, a CPU (central processing unit) of the printing apparatus 10, and controls the operation of each unit of the printing apparatus 10, for example, in response to instructions of a host PC (personal computer). According to the above described configuration, the printing apparatus 10 performs printing on each medium 50.

Figure 2A:
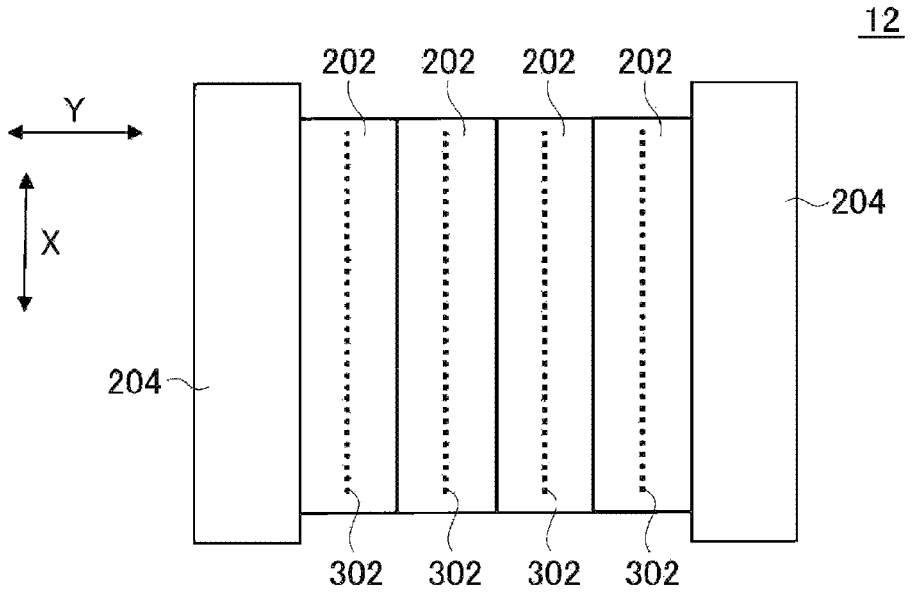
FIGS. 2A and 2B are views illustrating an example of a more detailed configuration of a head unit 12.
Figure 2B:
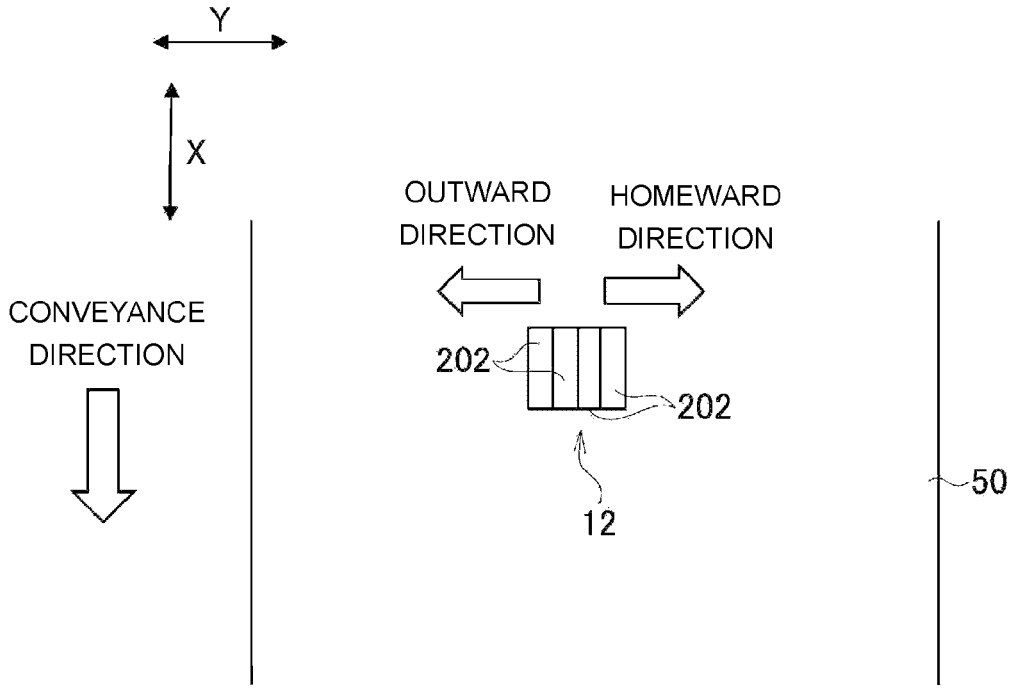

Now, a more specific configuration of the head unit 12 will be described in detail. FIGS. 2A and 2B show an example of a more detailed configuration of the head unit 12. FIG. 2A shows an example of the overall configuration of the head unit 12.

In the present embodiment, the head unit 12 includes the plurality of inkjet heads for ejecting ink drops of different colors, and the plurality of ultraviolet light sources 204. Each inkjet head 202 has a nozzle row 302 of a plurality of nozzles arranged side by side in the sub scan direction (the X direction in FIGS. 2A and 2E). Also, in the present embodiment, the plurality of inkjet heads 202 ejects ink drops of individual colors, for example, C, M, Y, and K, respectively. Further, for example, the plurality of inkjet heads 202 performs main scan operations in an outward direction which is one direction of the main scan direction, and performs main scan operations in a homeward direction which is the opposite direction to the outward direction.

Also, the plurality of inkjet heads 202 is installed side by side in the main scan direction (the Y direction in FIGS. 2A and 2B), for example, such that their positions in the sub scan direction are aligned. More specifically, in the present embodiment, the plurality of inkjet heads 202 is installed such that corresponding nozzles of the individual nozzle rows 302 are arranged side by side in the main scan direction while being aligned in the sub scan direction. Therefore, in each main scan operation, the plurality of inkjet heads 202 ejects ink drops of the individual colors onto the same area on the medium 50.

Also, in this case, the same area on the medium 50 means, for example, a band area on the medium 50 over which the plurality of inkjet heads 202 passes during a main scan operation. The plurality of inkjet heads 202 may eject ink drops onto different pixels included in the same band area, respectively. The method of selecting pixels to be subjected to ink drop ejection by each inkjet head 202 will be described below in more detail.

Also, an inkjet head for each color may be, for example, a composite head consisting of a plurality of inkjet heads. For example, each inkjet head 202 may be a stagger head having a plurality of inkjet heads staggered. Also, in the present embodiment, each inkjet head 202 ejects ink drops of ultraviolet curing ink.

The plurality of ultraviolet light sources 204 is light sources for irradiating ink on the medium 50 with ultraviolet light. For example, the plurality of ultraviolet light sources 204 is disposed on both sides of the arrangement of the plurality of inkjet heads 202 in the main scan direction, respectively. In this case, during each main scan operation, an ultraviolet light source 204 which is positioned on the rear side of the plurality of inkjet heads in the movement direction of the inkjet heads 202 irradiates ink on the medium 50 with ultraviolet light. According to this configuration, for example, it is possible to appropriately harden ink dots during each main scan operation.

However, in a modification of the configuration of the head unit 12, for example, it can be considered to use ink other than ultraviolet curing ink, as ink used for the inkjet heads 202. For example, it can also be considered to use solvent UV ink or the like obtained by diluting ultraviolet curing ink with a volatile organic solvent, as ink used for the inkjet heads 202. Also, it can be considered to use solvent ink, latex ink, or the like. In these cases, for example, it is preferable to install a heater or the like inside the platen 18 (see FIGS. 1A and 1B). Also, in a case where ultraviolet curing ink or solvent UV ink is not used, for example, in the configuration of the head unit 12, the ultraviolet light sources 204 may be omitted.

Now, the operation of the head unit 12 during printing will be described in more detail. FIG. 2B shows an example of the state of the head unit 12 during a main scan operation. As described above, in the present embodiment, the head unit 12 performs printing on the medium 50 by performing main scan operations in the outward direction and homeward direction of the main scan direction. Also, in this way, during each main scan operation, while the head unit 12 passes over a band area, it ejects ink drops of different colors (for example, individual colors C, M, Y, and K) from the plurality of inkjet heads 202 onto the band area, respectively.

Also, whenever the head unit 12 performs a predetermined number of main scan operations, the sub scan driver 16 (see FIGS. 1A and 1B) performs a sub scan operation by conveying the medium 50 in a conveyance direction. In this way, the sub scan driver 16 changes areas of the medium 50 to face the head unit 12. Also, thereafter, the head unit 12 performs the next main scan operation on the next band area. According to the present embodiment, it is possible to appropriately perform printing on the entire print area of the medium 50 by repeating main scan operations and sub scan operations.

Also, with respect to the timings of sub scan operations, more specifically, for example, it can be considered to perform one sub scan operation whenever one main scan operation is performed. In this case, in each of an interval between a main scan operation which is performed in the outward direction and a main scan operation which is performed in the homeward direction, and an interval between a main scan operation which is performed in the homeward direction and a main scan operation which is performed in the outward direction, a sub scan operation is performed.

Also, in the disclosure, the controller 20 (see FIGS. 1A and 1B) can set a predetermined first speed, and a second speed higher than the first speed, as the movement speed of the head unit 12 during main scan operations. In this case, more specifically, the first speed is, for example, the movement speed of the head unit 12 in a case of performing printing in a standard mode. Also, the second speed is, for example, the movement speed of the head unit 12 in a case of performing a high-speed scan mode. The second speed may be twice the first speed.

Now, an example of the method of selecting pixels to be subjected to ink drop ejection by each inkjet head 202 with respect to operations during each main scan operation will be described. In way to clarify the features of the printing apparatus 10 (see FIGS. 1A and 1B) of the present embodiment, first, an operation in a case of performing printing in the high-speed scan mode will be described.

Also, for convenience of explanation, with respect to the operation of performing printing in the high-speed scan mode, prior to a description of the operation of the printing apparatus 10 of the present embodiment, the operation of a configuration of the related art different from the printing apparatus 10 of the present embodiment will be described. Also, in way to simplify explanation, hereinafter, with a focus on two of the colors for printing, that is, magenta and cyan, the method of selecting pixels to be subjected to ink drop ejection will be described. Magenta and cyan are examples of a first color and a second color different from each other, respectively.

Figure 3A:
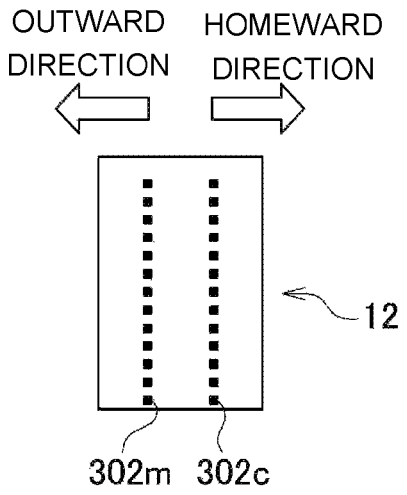
FIGS. 3A to 3C are views illustrating an example of an operation in a case of performing printing in a high-speed scan mode using a configuration according to the related art.
Figure 3B:
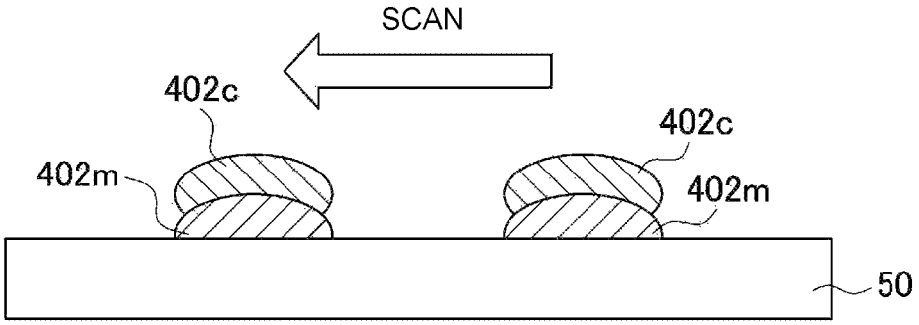
Figure 3C:
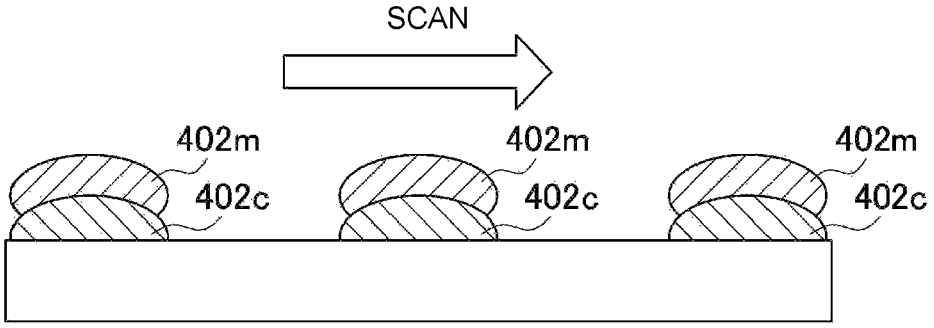

FIGS. 3A to 3C show an example of the operation in a case of performing printing in the high-speed scan mode by the configuration of the related art. FIG. 3A simply shows the configuration of a head unit 12. Even in the configuration of the related art, the head unit 12 can have a configuration identical or similar to the configuration shown in FIG. 2A. Further, in this case, it is possible to simplify the configuration of the head unit 12 with a focus on two of the colors for printing, that is, magenta and cyan, thereby obtaining, for example, a configuration as shown in FIG. 3A.

In the configuration shown in FIG. 3A, the head unit 12 has a nozzle row 302*m* and a nozzle row 302*c*. In this case, the nozzle row 302*m* is a nozzle row having a plurality of nozzles configured to eject magenta ink drops and arranged side by side in the sub scan direction. The nozzle row 302*c* is a nozzle row having a plurality of nozzles configured to eject cyan ink drops and arranged side by side in the sub scan direction. Also, in this case, the nozzle row 302*m* is an example of a first-color nozzle row. The nozzle row 302*c* is an example of a second-color nozzle row. The individual nozzles of the nozzle row 302*m* are examples of first-color nozzles. The individual nozzles of the nozzle row 302*c* are examples of second-color nozzles.

FIGS. 3B and 3C show examples of the state of ink dots 402*m* and 402*c* which are formed on a medium 50 during a main scan operation. FIG. 3B shows an example of the state of ink dots 402*m* and 402*c* which are formed when a main scan operation is performed in the outward direction. FIG. 3C shows an example of the state of ink dots 402*m* and 402*c* which are formed when a main scan operation is performed in the homeward direction. Also, in FIGS. 3B and 3C, the dots 402*m* are ink dots which are formed by ink drops ejected from the nozzles of the nozzle row 302*m*. The dots 402*c* are ink dots which are formed by ink drops ejected from the nozzles of the nozzle row 302*c*.

As described in association with FIGS. 2A and 2B, in a case of using the plurality of inkjet heads 202 (see FIGS. 2A and 2B) for ejecting ink drops of different colors, during each main scan operation, the plurality of inkjet heads 202 ejects ink drops onto the same band area. Also, in this case, more specifically, each inkjet head 202 ejects ink drops onto the positions of predetermined pixels on the medium 50.

Also, in the configuration of the related art, during each main scan operation, in general, the inkjet heads 202 for different colors eject ink drops onto the positions of the same pixels. Therefore, for example, as shown in FIGS. 3B and 3C, the ink dots 402*m* and 402*c* of different colors are formed so as to overlap at the positions of the individual pixels on the medium 50.

However, in this case, during each main scan operation, the movement direction of the head unit 12 decides the color overlap way at the positions of the individual pixels. More specifically, for example, in a case of performing amain scan operation in the outward direction as shown in FIG. 313, in the movement direction of the head unit 12, the nozzle row 302*m* is positioned on the front side, and the nozzle row 302*c* is positioned on the rear side. Therefore, at the positions of individual pixels included in a band area, ink drops ejected from the nozzles of the nozzle row 302*m* land earlier than ink drops ejected from the nozzles of the nozzle row 302*c*. Also, as a result, at the positions of the individual pixels, cyan ink dots 402*c* are superimposed on magenta ink dots 402*m*.

Meanwhile, for example, in a case of performing a main scan operation in the homeward direction shown in FIG. 3C, since the head unit 12 moves in the opposite direction to the outward direction, ink dots 402*m* and 402*c* overlap in reverse. As a result, in this case, at the positions of the individual pixels, magenta ink dots 402*m* are superimposed on cyan ink dots 402*c*.

As described above, in a case of performing main scan operations in the outward direction and the homeward direction in the configuration of the related art, during one main scan operation, with respect to individual pixels which are formed in a band area, the color overlap order is constant. However, the color overlap way in a case of performing a main scan operation in the outward direction is the reverse of the color overlap way in a case of performing a main scan operation in the homeward direction. Further, as described above, this phenomenon causes color unevenness such as color transition.

With respect to this, the inventor of this application found that, in some cases like a case of performing printing in a high-speed scan mode, by using a method of selecting pixels to be ink dots during each main scan operation different from known methods, it is possible to appropriately suppress color unevenness such as color transition. Therefore, hereinafter, this point will be described in more detail.

First, the high-speed scan mode will be described in more detail. In a case of performing printing in the inkjet mode, the resolution of the main scan direction is decided, for example, on the basis of the relation between the cycle of ink drop ejection and the movement speed of the inkjet head. In contrast with this, as described above, the high-speed scan mode is a printing mode in which the movement speed of the inkjet head during main scan operations is twice a standard speed. Therefore, in the case of performing printing in the high-speed scan mode, in general, the resolution in the main scan direction is half of that in a case of performing main scan operations at the standard speed (hereinafter, referred to as the standard mode).

Also, as a result, in the case of performing printing in the high-speed scan mode, an ink dot arrangement to be formed during each main scan operation is the same as an arrangement obtained by omitting every other dot from an arrangement for the standard mode. Therefore, in the cases shown in FIGS. 3B and 3C, the interval between the pixel positions where there are the dots 402*m* and 402*c* is twice that of the standard mode. In other words, in the case of performing printing at the resolution of the standard mode, in FIGS. 3B and 3C, even positions between the pixel positions where there are the dots 402*m* and 402*c* are pixel positions where ink dots are formed.

For this reason, the inventor of this application thought it could be possible to suppress color unevenness such as color transition by using even the positions between the pixel positions of FIGS. 3B and 3C where there are the dots 402*m* and 402*c*. More specifically, the inventor of this application thought of a method of performing printing, for example, by operations to be described below.

Figure 4A:
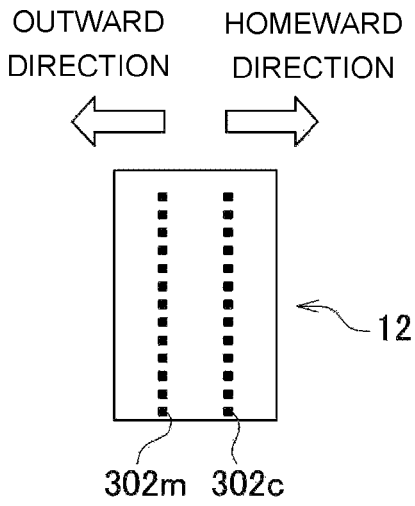
FIGS. 4A to 4C are views illustrating an example of an operation in a case of performing printing in the high-speed scan mode in the printing apparatus 10 according to the embodiment of the disclosure.
Figure 4B:
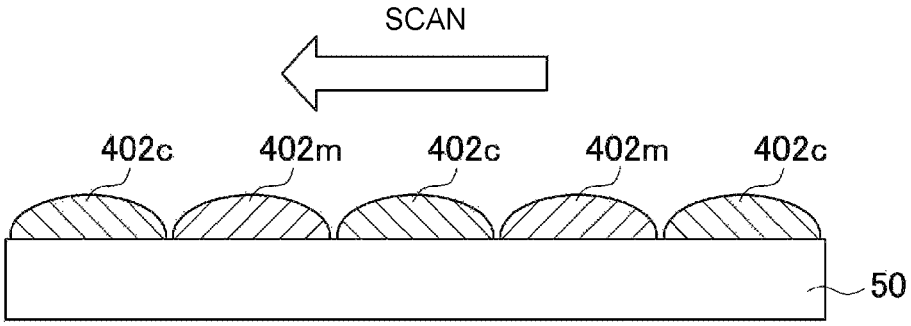
Figure 4C:
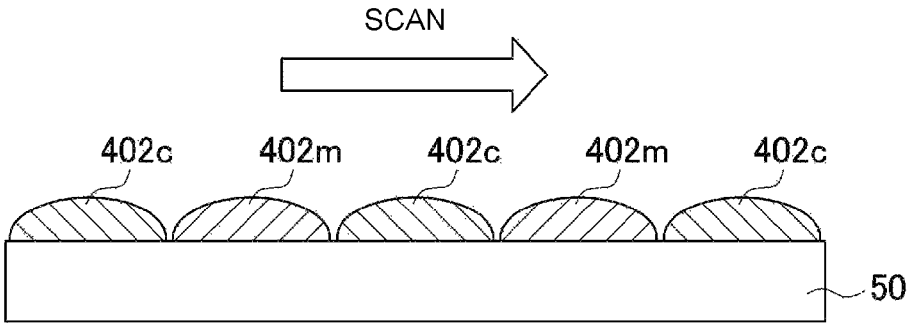

FIGS. 4A to 4C show an example of an operation in a case of performing printing in the high-speed scan mode in the printing apparatus 10 according to the embodiment of the disclosure. FIG. 4A simply shows the configuration of the head unit 12 shown in FIG. 2A. FIGS. 4B and 4C show examples of the state of ink dots 402*m* and 402*c* which are formed on the medium 50 during a main scan operation. Also, in FIGS. 4A to 4C, components denoted by the same reference symbols as those of FIGS. 3A to 3C have features identical or similar to those of the components of FIGS. 3A to 3C, except for points to be described below.

As described above, in the present embodiment, during a main scan operation, at the positions between the pixel positions of FIGS. 3B and 3C where there are the dots 402*m* and 402*c*, magenta ink dots 402*m* and cyan ink dots 402*c* are formed. More specifically, the pixel positions are managed at the same resolution as that for the standard mode, and the dots 402*m* and the dots 402*c* are formed at pixel positions based on different arrangements obtained by omitting every other dot from the arrangement for the standard mode, respectively, not at pixel positions based on the same arrangement. Therefore, for example, as shown in FIGS. 4B and 4C, the dots 402*m* and the dots 402*c* are formed such that the dots 402*m* and the dots 402*c* are alternately arranged in the main scan direction.

In this configuration, for example, if focusing attention on only one of magenta and cyan, the ink dots of the corresponding color are formed at the pixel positions based on one arrangement obtained by omitting every other dot from the arrangement for the standard mode. Therefore, even if the inkjet head moves at the movement speed of the high-speed scan mode, it is possible to appropriately form ink dots at individual pixel positions. Also, in this case, during one main scan operation, the magenta ink dots 402*m* and the cyan ink dots 402*c* are formed so as not to overlap. Therefore, between main scan operations which are performed in the outward direction and main scan operation which are performed in the homeward direction, a difference in the color overlap way does not occur. Therefore, according to this configuration, it is possible to appropriately suppress color unevenness such as color transition. Also, as a result, for example, it is possible to more appropriately perform high-quality printing.

Here, as described above, magenta and cyan are examples of a first color and a second color different from each other, respectively. Therefore, if generalizing the feature of the printing apparatus 10 of the present embodiment, it can be said that the operation of the controller 20 (see FIGS. 1A and 1B) of selecting pixels to be subjected to ink drop ejection during each main scan operation is an operation of selecting some pixels from pixels included in an area of a medium which is the object of the corresponding main scan operation, as first-color ejection object pixels for which ink drops of the first color should be ejected, and selecting at least some pixels from the pixels which are included in the area of the medium which is the object of the main scan operation and are not the first-color ejection object pixels, as second-color ejection object pixels for which ink drops of the second color should be ejected.

Also, in this case, during each main scan operation, more specifically, for example, it is preferable that the controller 20 should select first-color ejection object pixels and second-color ejection object pixels such that the first-color ejection object pixels are different from the second-color ejection object pixels. According to this configuration, for example, it is possible to appropriately occurrence of color unevenness. Also, as a result, for example, it is possible to more appropriately perform high-quality printing.

Also, as shown in FIGS. 4B, 4C and the like, for example, in a case of performing printing in the high-speed scan mode, during each main scan operation on each position of the medium 50, it is preferable that the controller 20 should select first-color ejection object pixels and second-color ejection object pixels such that the first-color ejection object pixels and the second-color ejection object pixels are alternately arranged in the main scan direction. According to this configuration, with respect to the first color and the second color, it is possible to more surely prevent the colors from overlapping at individual pixel positions.

Also, similarly in the case of using the head unit 12 shown in FIG. 2A and the like, in a case of performing printing using ink of three or more colors (for example, ink of three or more colors of the individual colors C, M, Y, and K), if possible, it is preferable that the head unit 12 should eject ink drops of the three or more colors onto different pixel positions. According to this configuration, for example, it is possible to more appropriately prevent the color overlap way from being constant in one band area. Also, as a result, it is possible to appropriately suppress color unevenness and the like.

Also, as a method of implementing a mode for ejecting ink drops of three or more colors onto different pixel positions in the case of performing printing using ink of three or more colors, for example, a method of appropriately adjusting the resolution of the main scan direction can be considered. Also, for example, it can be considered to implement the above described mode by performing printing in a multi-pass mode. In this case, the multi-pass mode is, for example, a mode for performing a plurality of main scan operations corresponding to a plurality of printing passes on each position of the medium 50. In the case of using the multi-pass mode, more specifically, for example, in a case where printing is performed in the high-speed scan mode and the number of passes is 2, with respect to ink of four colors (for example, ink of the colors C, M, Y, and K), it is possible to eject ink drops of the individual colors onto different pixel positions.

Also, in a case of using many colors in printing, during each main scan operation, with respect to every color, different pixels may be selected as ejection object pixels for the individual colors, respectively. In this case, since the degree of freedom in selecting pixels decreases, it may be difficult to appropriately select pixels. For this reason, in a case of performing printing using three or more colors, for example, with a focus on only some colors of the used ink colors, it is possible to select the first color and the second color. In this case, for example, it is preferable to select a combination of such colors that the way in which the colors overlap is likely to influence visibility. According to this configuration, for example, even in a case where many colors are used, it is possible to appropriately suppress color unevenness and the like.

Also, more specifically, in a case of using ink of the colors C, M, Y, and K, it is considered that, particularly, the color overlap way of magenta and cyan is likely to influence visibility. For this reason, as the first color and the second color, for example, it is preferable to select magenta and cyan. Also, in other printing conditions, for example, it can also be considered to select a combination of colors other magenta and cyan as the first color and the second color.

Now, with respect to the operation of the printing apparatus 10 of the present embodiment, an operation which can be performed even in a case of performing printing in a mode other than the high-speed scan mode will be described. As described above, a configuration for ejecting ink drops of different colors onto different pixel positions in a case of using ink of two or more colors can be implemented even by performing printing in the multi-pass mode. Also, in this case, it can also be considered to perform printing in a mode other than the high-speed scan mode. For this reason, hereinafter, a printing operation which is performed in a case of performing printing in the multi-pass mode will be described.

Figure 5A:
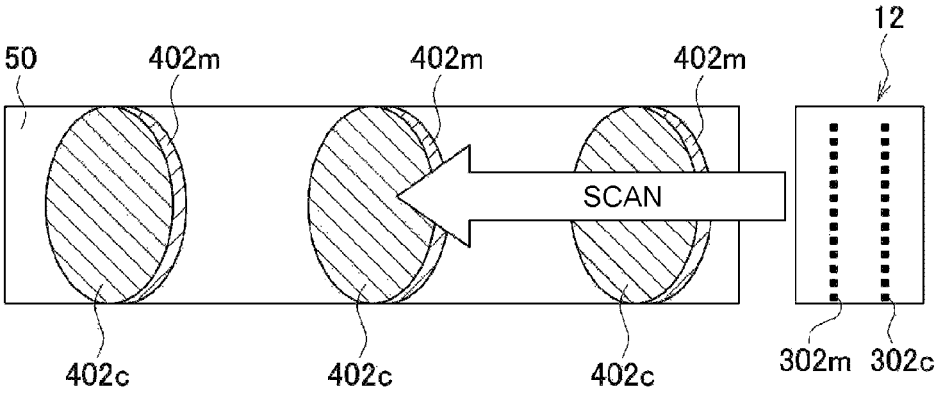
FIGS. 5A and 5B are views illustrating an example of an operation in a case of performing printing in a multi-pass mode.
Figure 5B:
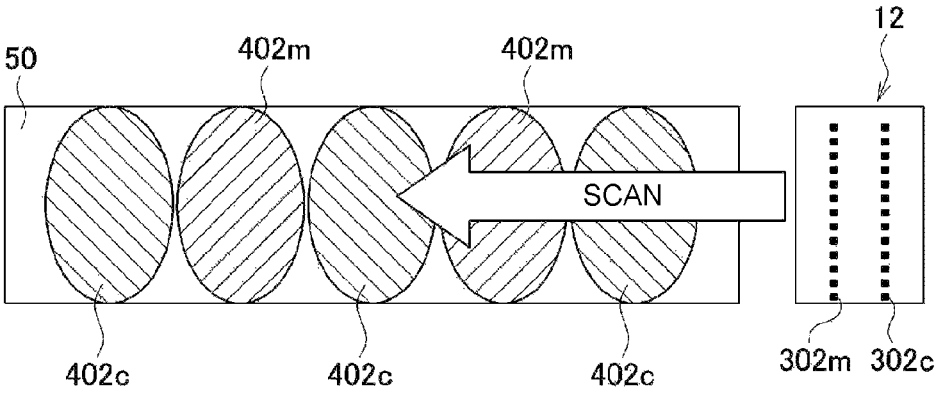

FIGS. 5A and 5B show an example of the operation which is performed in the case of performing printing in the multi-pass mode. In FIGS. 5A and 5B, components denoted by the same reference symbols as those of FIGS. 3A to 3C or FIGS. 4A to 4C have features identical or similar to those of the components of FIGS. 3A to 3C or FIGS. 4A to 4C, except for points to be described below. Also, similarly in FIGS. 3A to 3C and FIGS. 4A to 4C, even in FIGS. 5A and 5B, the configuration of the head unit 12 is simply shown. Also, even with respect to printing in the multi-pass mode, for convenience of explanation, the operation of the configuration of the related art will be first described.

FIG. 5A is a view for explaining the operation in the multi-pass mode which is performed in the configuration of the related art, and shows an example of the state of ink dots 402*m* and 402*c* which are formed on the medium 50 during a main scan operation. In the case of performing printing in the multi-pass mode, during a main scan operation corresponding to each printing pass which is performed on each position of the medium 50, the head unit 12 ejects ink drops on the basis of a predetermined mask data item (a mask). In this case, the mask data item is, for example, a data item for designating pixels to be subjected to ink drop ejection during a main scan operation corresponding to each printing pass, and designates some pixels from pixels included in a band area over which the head unit 12 passes during the corresponding main scan operation.

Also, in the configuration of the related art, as the mask data item, in general, a common mask data item is used for the inkjet heads for different colors included in the head unit 12. Therefore, during each main scan operation, the inkjet heads for different colors included in the head unit 12 eject ink drops onto the same pixel positions on the medium 50. More specifically, for example, in way to simplify explanation, in a case of focusing attention on two colors, magenta and cyan of the colors which are used in printing, during each main scan operation, the head unit 12 ejects ink drops from the nozzles of the nozzle row 302*m* for magenta and the nozzles of the nozzle row 302*c* for cyan onto the same pixel positions on the medium 50. Also, as a result, magenta ink dots 402*m* and cyan ink dots 402*c* are formed at the same pixel positions on the medium 50, so as to overlap as shown in FIG. 5A.

Also, in this case, similarly in the case shown in FIGS. 3A to 3C or the like, the color overlap way at each pixel position is constant in one band area, and is reversed according to whether the movement direction of the head unit 12 during a corresponding main scan operation is the outward direction or the homeward direction. More specifically, for example, in the configuration of the related art, in a case of performing one main scan operation using two colors of magenta and cyan, as the result of the printing, at each pixel position, ink dots overlap as shown in FIG. 5A. Also, in the case of performing printing in the multi-pass mode, on those ink dots, ink is further superimposed by the subsequent printing passes. With respect to ink overlap ways in the multi-pass mode will be described below in detail.

In contrast with this, in the present embodiment, printing in the multi-pass mode is performed as follows. FIG. 5B is a view for explaining an operation which is performed in the multi-pass mode in the present embodiment, and shows an example of the state of ink dots 402*m* and 402*c* which are formed on the medium 50 during a main scan operation. In the present embodiment, in the case of performing printing in the multi-pass mode, for example, the printing apparatus 10 (see FIGS. 1A and 1B) uses different mask data items for different colors. More specifically, in this case, with respect to pixels to be subjected to magenta ink drop ejection and pixels to be subjected to cyan ink drop ejection, the controller 20 (see FIGS. 1A and 1B) performs pixel selection on the basis of different mask data items. As a method of using different mask data items for different colors, for example, a method of using a common mask data item having the same pattern while shifting the common mask data item (mask shifting) can be considered.

According to this configuration, for example, it is possible to appropriately select different pixels as pixels as ink drop ejection object pixels of different colors, respectively. Also, more specifically, for example, in the configuration of the present embodiment, in a case of performing one main scan operation using ink of two colors of magenta and cyan, as the result of printing, ink dots of different colors are formed at different pixel positions as shown in FIG. 5B.

Now, ink overlap ways in the case of performing printing in the multi-pass mode will be described in more detail. FIGS. 6A to 6D and FIGS. 7A to 7D show examples of ink overlap ways in the case of performing printing in the multi-pass mode. FIGS. 6A to 6D shows the ink overlap way in the multi-pass mode which is performed in the configuration of the related art.

Also, in FIGS. 6A to 6D and FIGS. 7A to 7D, components denoted by the same reference symbols as those of FIGS. 1A to 5B have features identical or similar to those of the components of FIGS. 1A to FIG. 5B, except for points to be described below. Also, with respect to FIGS. 6A to 6D and FIGS. 7A to 7D, for convenience of explanation, the ink overlap way in a case where the number of printing passes is 2 will be described. In this case, during each main scan operation, ink dots of each color are formed side by side in the main scan direction, at intervals of twice the pitch of the print resolution. The pitch of the print resolution means, for example, the interval between pixels at the resolution of printing which is performed in the multi-pass mode. Therefore, in a case of focusing attention on ink dots which are formed during one main scan operation, the arrangement of ink dots which are formed is similar, for example, to that in the case of the high-speed scan mode described with reference to FIGS. 3A, 3B and the like.

Also, in FIGS. 3A to 5B, for convenience of illustration, the ink dot diameter is shown to be smaller than the pitch of the print resolution. However, in some cases like a case of performing printing at a high resolution, frequently, the dot diameter is larger than the pitch of the print resolution. Further, in this case, for example, even in a case of forming ink dots on the basis of the arrangement obtained by obtained by omitting every other dot, each area on the medium in the main scan direction is filled with the arrangement of the ink dots to an extent, without any void. Also, as a result, in each of the subsequent printing passes, ink dots are formed on the ink dots formed during previous printing passes, so as to overlap. Therefore, for example, in the configuration of the related art, the overlap way causes a difference in tint. In view of these points, FIGS. 6A to 6D and FIGS. 7A to 7D were made. Also, for simplifying explanation, FIGS. 6A to 6D and FIGS. 7A to 7D were made with a focus on two colors, magenta and cyan of the colors which are used in printing.

Figure 6A:
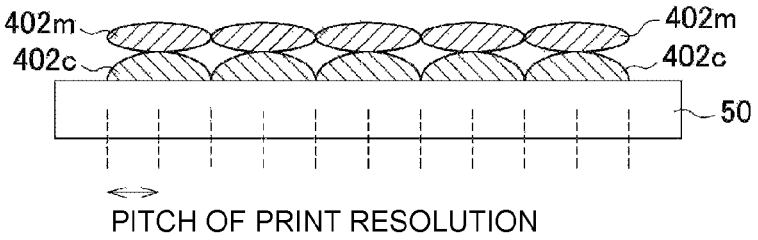
FIGS. 6A to 6D are views illustrating ink overlap ways in the multi-pass mode which is performed in the configuration of the related art.

FIG. 6A shows an example of the arrangement of ink dots which are formed by the first printing pass, with respect to the operation of the multi-pass mode of the configuration of the related art. In this case, as described with reference to FIG. 5A, magenta ink dots 402*m* and cyan ink dots 402*c* are formed at the same pixel positions on the medium 50, at intervals of twice the pitch of the print resolution, so as to overlap each other. Also, the order in which magenta ink dots 402*m* and cyan ink dots 402*c* overlap in a case of performing a main scan operation in the outward direction is the reverse of that in a case of performing a main scan operation in the homeward direction.

Figure 6B:
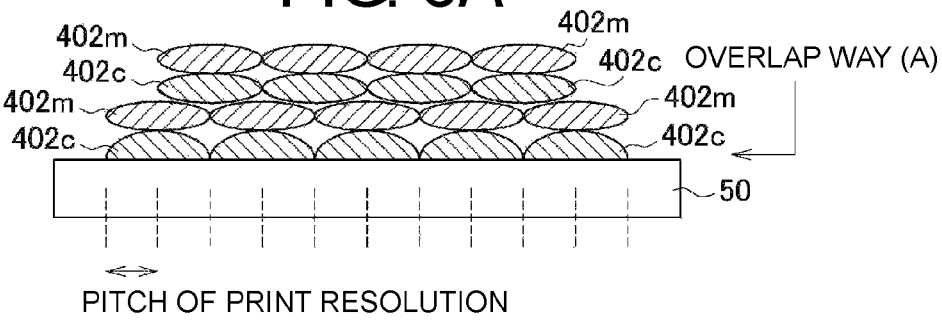
Figure 6C:
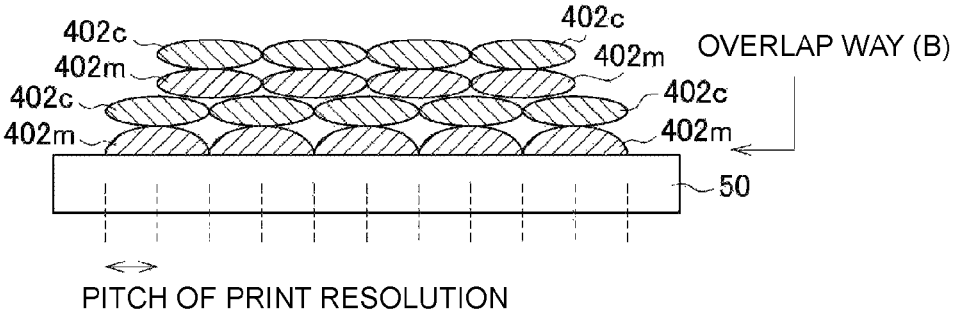

FIGS. 6B and 6C show examples of the ink overlap way when the second printing pass has finished. In a case where the number of printing passes is 2, in the second printing pass, ink dots are formed in the main scan direction so as to be positioned between the ink dots formed in the first printing pass. Therefore, in the second printing pass, ink dots are formed on the ink dots formed in the first printing pass, so as to be deviated from the ink dots of the first printing pass by the pitch of the print resolution.

In the configuration for performing main scan operations in the outward direction and main scan operations in the homeward direction, in a case of performing printing in the multi-pass mode, in general, according to the position of a medium, printing of a first printing pass may start with a main scan operation in the outward direction, and may start with a main scan operation in the homeward direction. Also, as a result, the direction of a main scan operation of performing printing of a second printing pass varies depending on the position of the medium. For this reason, in this case, at individual positions on the medium, ink dots overlap in two overlap ways as shown in FIGS. 6B and 6C.

Figure 6D:
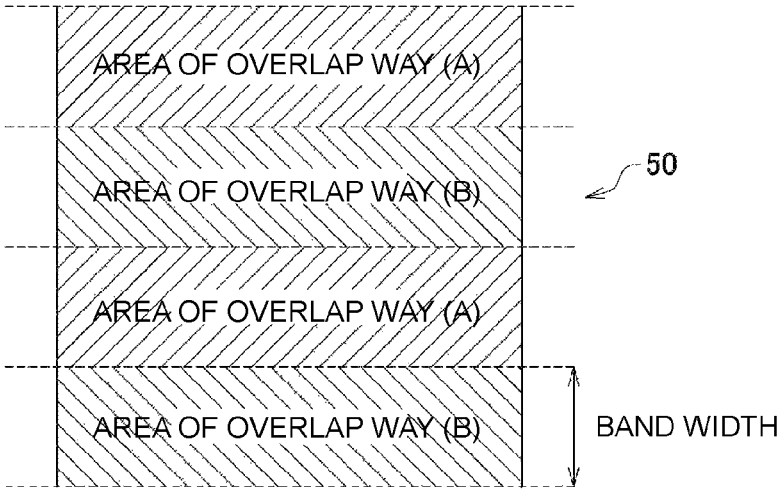

FIG. 6D shows an example of the ink overlap ways at individual positions on the medium. Due to the difference in the direction of the main scan operation of the first printing pass, the ink overlap ways at individual positions alternate in units of the width (band width) of a band area which is an area corresponding to the width of one printing pass. More specifically, for example, in a case where the ink overlap way shown in FIG. 6B is referred to as the overlap way (A), and the ink overlap way shown in FIG. 6B is referred to as the overlap way (B), areas where ink dots overlap in the overlap way (A) and areas where ink dots overlap in the overlap way (B) alternate in unit of the band width.

However, since the order in which ink drops overlap in a case where ink dots of different colors overlap in the overlap way (A) is the reverse of that in a case where ink dots of different colors overlap in the overlap way (B), between both cases, a difference invisible tint occurs. For this reason, between the band areas where ink dots overlap in the overlap way (A) and the band areas where ink dots overlap in the overlap way (B), a difference in tone occurs. Also, as a result, color unevenness such as color transition occurs. For this reason, in this case, similarly in the case shown in FIGS. 3A to 3C and the like, color unevenness such as color transition becomes a problem.

Figure 7A:
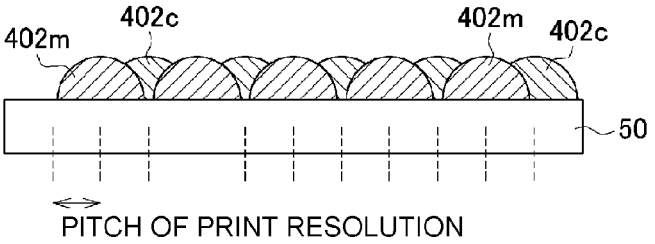
FIGS. 7A to 7D are views illustrating ink overlap ways in the multi-pass mode which is performed in the configuration of the embodiment.

Now, a case of performing printing in the multi-pass mode by a method of the present embodiment will be described. FIGS. 7A to 7D show ink overlap ways in the multi-pass mode which is performed in the configuration of the present embodiment. FIG. 7A shows an example of the arrangement of ink dots which are formed by a first printing pass. In this case, as described with reference to FIG. 5B, magenta ink dots 402*m* and cyan ink dots 402*c* are formed at different pixel positions, respectively.

Figure 7B:
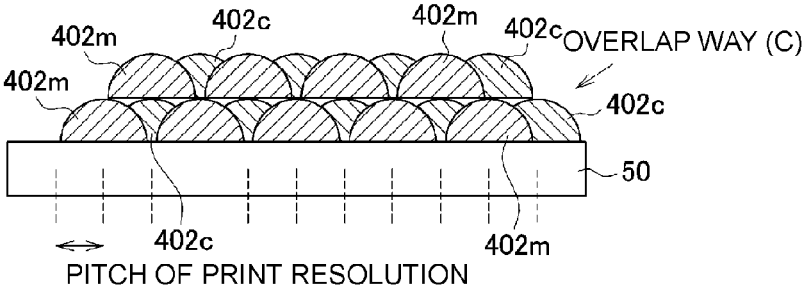
Figure 7C:
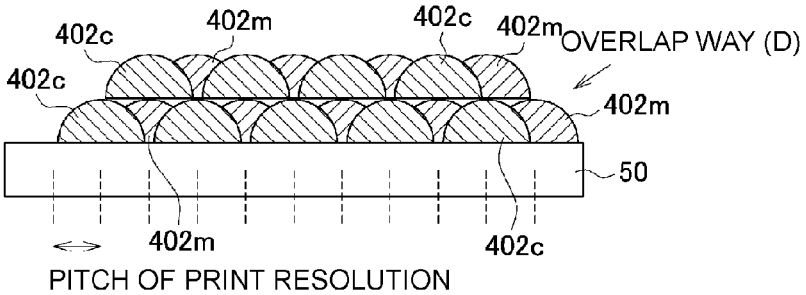
Figure 7D:
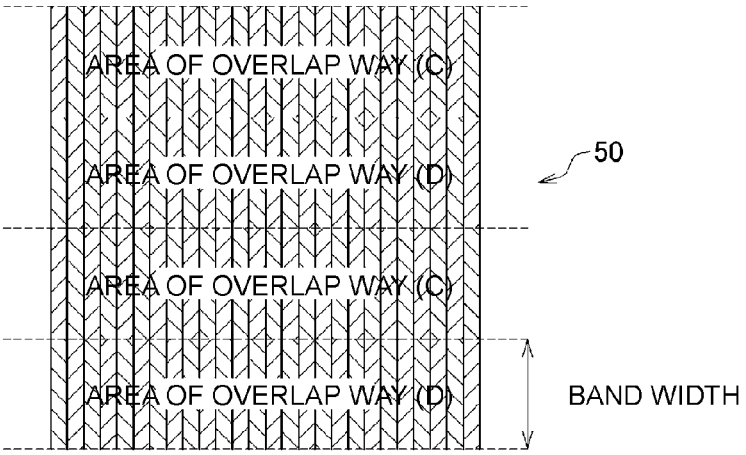

FIGS. 7B and 7C show examples of ink-dot overlap ways after a second printing pass. FIG. 7D shows an example of the ink overlap way at each position on the medium. Even in this case, a main scan operation of performing printing of a first printing pass on individual positions of the medium may be a main scan operation in the outward direction, and may be a main scan operation in the homeward direction. Also, as a result, the direction of a main scan operation of performing printing of a second printing pass varies depending on the position of the medium. For this reason, even in this case, at individual positions on the medium, ink dots overlap in two overlap ways as shown in FIGS. 7B and 7C. Also, for example, in a case where the ink overlap way shown in FIG. 7B is referred to as the overlap way (C), and the ink overlap way shown in FIG. 7C is referred to as the overlap way (D), areas where ink dots overlap in the overlap way (C) and areas where ink dots overlap in the overlap way (D) alternate in unit of a band width as shown in FIG. 7D.

However, not only in the case of the overlap way (C) but also in the case of the overlap way (D), on the ink overlap surface, not only magenta ink dots 402*m* but also cyan ink dots 402*c* are formed. Also, in the main scan direction, the ink dots of the individual colors are arranged alternately in units of the pitch of the print resolution. Therefore, the difference between the overlap ways (C) and (D) does not cause a difference in visible tint. Therefore, in this case, between the areas where ink dots overlap in the overlap way (C) and the areas where ink dots overlap in the overlap way (D), a difference in tone does not occur. Also, as a result, color unevenness such as color transition does not occur.

Therefore, according to the present embodiment, it is possible to implement a configuration in which different mask data items are used for different colors such that, even in a case of performing printing in the multi-pass mode, during each main scan operation, it is difficult for ink dots of a plurality of colors to overlap. Also, as a result, it is possible to appropriately suppress occurrence of color unevenness attributable to, for example, a difference in the color overlap order, and more appropriately perform high-quality printing.

Also, similarly in the case described with reference to FIGS. 3A and 3B and FIGS. 4A and 4B, even in the case described with reference to FIGS. 5A to 7D, magenta and cyan are examples of the first color and the second color. Therefore, if generalizing the feature of the case of performing printing in the multi-pass mode, for example, it can be said that, in each of the plurality of printing passes which is performed on each position of a medium 50, the controller 20 selects first-color ejection object pixels and second-color ejection object pixels on the basis of mask data, and selects the first-color ejection object pixels and the second-color ejection object pixels on the basis of different mask data items.

Until now, the case where the number of printing passes is 2 has been described. Further, as the method of using different mask data items for different colors, the case of shifting formation positions of ink dots of the individual colors by the pitch of the print resolution, for example, by mask shifting has been described. However, the number of printing passes may be larger than 2. Also, it can be considered to use mask data items having different patterns for different colors, as the mask data items for different colors. Even in this case, by setting the patterns such that it is difficult for ink dots of the individual colors to overlap, it is possible to appropriately suppress occurrence of color unevenness attributable to, for example, a difference in the color overlap order. Also, as a result, for example, it is possible to more appropriately perform high-quality printing.

Figure 8A:
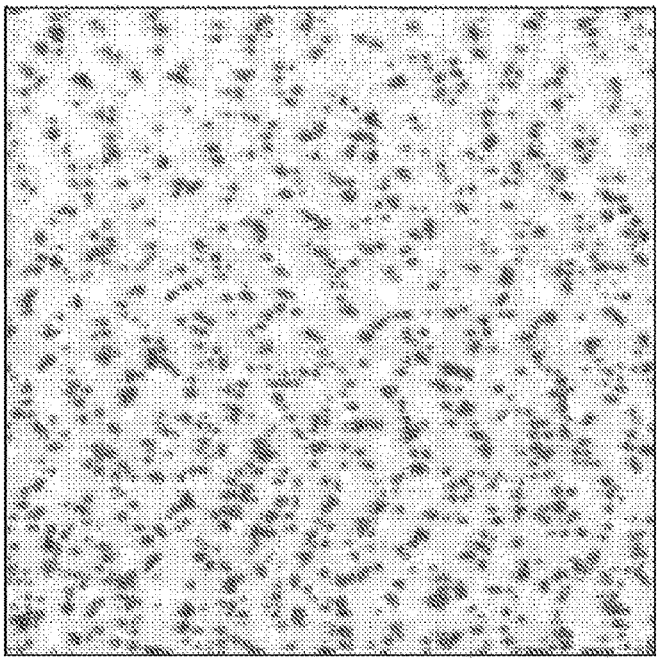
FIGS. 8A and 8B show an example of a print result in a case of using mask data items having different patterns for individual colors.
Figure 8B:
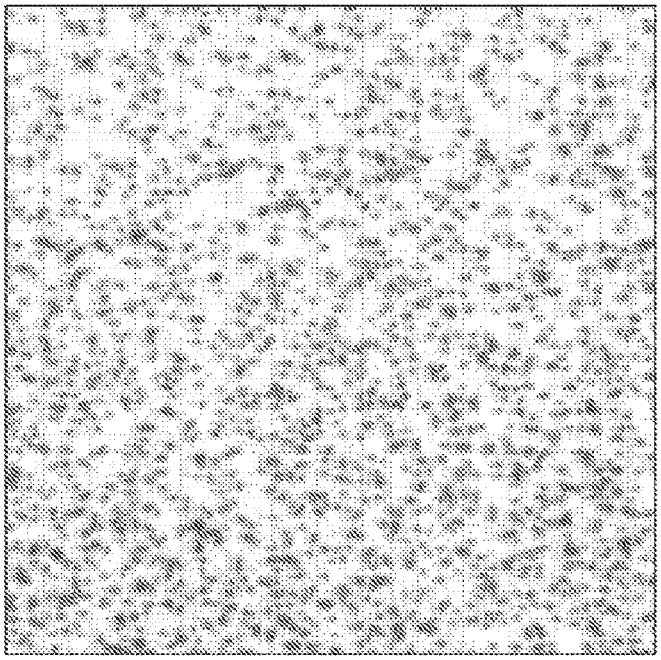

FIGS. 8A and 8B show examples of print results in a case of using mask data items having different patterns for different colors. FIG. 8A shows an example of a print result in a case of using a common mask data item for different colors. In this case, as can be seen from FIG. 8A, ink dots of different colors are formed at the same positions, so as to overlap. Therefore, in this case, color unevenness such as color transition occurs.

FIG. 8B shows an example of a print result in a case of using mask data items having different patterns for different colors. In this case, it is preferable that different patterns for different colors should be set such that it is difficult for ink dots of the individual colors to overlap. In this configuration, for example, as can be seen from FIG. 8B, it is possible to form a lot of dots at different positions depending on the individual colors. Therefore, according to this configuration, it is possible to appropriately suppress color unevenness such as color transition.

Although the disclosure has been described above by way of the embodiment, the technical scope of the disclosure is not limited to the scope described in the embodiment. It is apparent to those skilled in the art that it is possible to make various changes or modifications in the above described embodiment. It is apparent from a description of claims that forms obtained by making such changes or modifications can also be included in the technical scope of the disclosure.

INDUSTRIAL APPLICABILITY

The disclosure can be suitably used, for example, in printing devices.

The invention claimed is:

1. A printing apparatus for performing printing on a medium in an inkjet method, comprising:

a head unit configured to eject ink drops onto the medium by performing main scan operations of ejecting ink drops while moving in a main scan direction which is predetermined;

a main scan driver configured to drive the head unit to perform the main scan operations; and a controller configured to control the printing operation on the medium by controlling the main scan operations of the head unit and the main scan driver, wherein, the head unit includes a first-color nozzle for ejecting ink drops of a first color, and a second-color nozzle for ejecting ink drops of a second color different from the first color, the first-color nozzle and the second-color nozzle are installed, such that they are arranged side by side in the main scan direction and their positions in a sub scan direction perpendicular to the main scan direction are aligned, in a case where one direction of the main scan direction is defined as an outward direction, and an opposite direction to the outward direction is defined as a homeward direction, the head unit performs main scan operations of the outward direction in which the head unit ejects ink drops while moving in the outward direction, and performs main scan operations of the homeward direction in which the head unit ejects ink drops while moving in the homeward direction, and during each main scan operation, as first-color ejection object pixels for which ink drops of the first color should be ejected, the controller selects some pixels from pixels included in an area of the medium which is an object of a corresponding main scan operation, as second-color ejection object pixels for which ink drops of the second color should be ejected, the control unit selects at least some pixels other than the first-color ejection object pixels, from the pixels included in the area of the medium which is the object of the corresponding main scan operation, and the controller selects the first-color ejection object pixels and the second-color ejection object pixels such that the first-color ejection object pixels and the second-color ejection object pixels are arranged on a same straight line parallel to the main scan direction.

2. The printing apparatus according to claim 1, wherein the head unit includes a first-color nozzle row having a plurality of first-color nozzles arranged side by side in the sub scan direction, and a second-color nozzle row having a plurality of second-color nozzles arranged side by side in the sub scan direction, and the first-color nozzle row and the second-color nozzle row are formed side by side in the main scan direction.

3. A printing apparatus for performing printing on a medium in an inkjet method, comprising:

a head unit configured to eject ink drops onto the medium by performing main scan operations of ejecting ink drops while moving in a main scan direction which is predetermined;

a main scan driver configured to drive the head unit to perform the main scan operations; and a controller configured to control the printing operation on the medium by controlling the main scan operations of the head unit and the main scan driver, wherein, the head unit includes a first-color nozzle for ejecting ink drops of a first color, and a second-color nozzle for ejecting ink drops of a second color different from the first color, the first-color nozzle and the second-color nozzle are installed, such that they are arranged side by side in the main scan direction and their positions in a sub scan direction perpendicular to the main scan direction are aligned, in a case where one direction of the main scan direction is defined as an outward direction, and an opposite direction to the outward direction is defined as a homeward direction, the head unit performs main scan operations of the outward direction in which the head unit ejects ink drops while moving in the outward direction, and performs main scan operations of the homeward direction in which the head unit ejects ink drops while moving in the homeward direction, and during each main scan operation, as first color ejection object pixels for which ink drops of the first color should be ejected, the controller selects some pixels from pixels included in an area of the medium which is an object of a corresponding main scan operation, as second-color ejection object pixels for which ink drops of the second color should be ejected, the control unit selects at least some pixels other than the first-color ejection object pixels, from the pixels included in the area of the medium which is the object of the corresponding main scan operation, wherein the controller can set a first speed which is predetermined, and a second speed higher than the first speed, as a movement speed of the head unit in a case of performing the main scan operations, and during a main scan operation of moving the head unit at the second speed, as the first-color ejection object pixels, the controller selects some pixels from the pixels included in an area of the medium which is an object of the corresponding main scan operation, and as the second-color ejection object pixels, the controller selects at least some pixels other than the first-color ejection object pixels, from the pixels included in the area of the medium which is the object of the corresponding main scan operation.

4. The printing apparatus according to claim 1, wherein during each main scan operation on each position of the medium, the controller selects the first-color ejection object pixels and the second-color ejection object pixels such that the first-color ejection object pixels and the second-color ejection object pixels are arranged alternately in the main scan direction.

5. The printing apparatus according to claim 1, wherein the printing apparatus performs printing on the medium by a multi-pass mode in which a plurality of main scan operations corresponding to a plurality of printing passes is performed on each position of the medium.

6. The printing apparatus according to claim 3, wherein the printing apparatus performs printing on the medium by a multi-pass mode in which a plurality of main scan operations corresponding to a plurality of printing passes is performed on each position of the medium.

7. The printing apparatus according to claim 1, wherein the printing apparatus performs printing using ink of three or more colors, the head unit includes a plurality of nozzles for ejecting ink drops of the three or more colors, respectively, and during each main scan operation, the head unit ejects ink drops of the three or more colors, onto different pixel positions, respectively.

8. The printing apparatus according to claim 1, wherein the printing apparatus performs printing using ink of three or more colors, the head unit includes a plurality of nozzles for ejecting ink drops of the three or more colors, respectively, the plurality of nozzles for ejecting ink drops of the three or more colors is installed, such that they are arranged side by side in the main scan direction and their positions in the sub scan direction are aligned, the first-color nozzle is any one nozzle of the arrangement of the plurality of nozzles arranged side by side in the main scan direction, and the second-color nozzle is any one nozzle other than the first-color nozzle, of the plurality of nozzles arranged side by side in the main scan direction.

9. A printing method of performing printing on a medium in an inkjet method, wherein the printing method uses a head unit configured to eject ink drops onto the medium by performing main scan operations of ejecting ink drops while moving in a main scan direction which is predetermined, the printing method controls the main scan operations of the head unit, such that the head unit performs printing on the medium, the head unit includes a first-color nozzle for ejecting ink drops of a first color, and a second-color nozzle for ejecting ink drops of a second color different from the first color, the first-color nozzle and the second-color nozzle are installed, such that they are arranged side by side in the main scan direction and their positions in a sub scan direction perpendicular to the main scan direction are aligned, in a case where one direction of the main scan direction is defined as an outward direction, and the opposite direction to the outward direction is defined as homeward direction, the printing method controls the head unit such that the head unit performs main scan operations of the outward direction in which the head unit ejects ink drops while moving in the outward direction, and performs main scan operations of the homeward direction in which the head unit ejects ink drops while moving in the homeward direction, and during control on each main scan operation, as first-color ejection object pixels for which ink drops of the first color should be ejected, the printing method selects some pixels from pixels included in an area of the medium which is an object of the corresponding main scan operation, and as second-color ejection object pixels for which ink drops of the second color should be ejected, the printing method selects at least some pixels other than the first-color ejection object pixels, from the pixels included in the area of the medium which is the object of the corresponding main scan operation, and the controller selects the first-color ejection object pixels and the second-color ejection object pixels such that the first-color ejection object pixels and the second-color ejection object pixels are arranged on a same straight line parallel to the main scan direction.

* * * * *